United States Patent [19]

Bunce et al.

[11] Patent Number: 5,011,042

[45] Date of Patent: Apr. 30, 1991

[54] VENDING SYSTEMS FOR HOT FOODS

[75] Inventors: Martin C. Bunce; David W. Helps, both of London; Leonard A. Jenkins, Southmoor; Adrian C. Noke, Wantage, all of England

[73] Assignee: CMB Foodcan plc, Corcester, England

[21] Appl. No.: 336,062

[22] Filed: Apr. 11, 1989

[30] Foreign Application Priority Data

Apr. 11, 1988 [GB] United Kingdom ..... 8808456
Apr. 28, 1988 [GB] United Kingdom ..... 8810140

[51] Int. Cl.[5] ..... G07F 11/72

[52] U.S. Cl. ..... 221/150 A; 219/10.55 R; 219/10.55 E; 219/10.55 D

[58] Field of Search ..... 221/150 R, 150 HC, 150 A, 221/30, 31, 232; 99/357; 219/10.55 R, 10.55 B, 10.55 E, 10.55 F, 10.55 D

[56] References Cited

U.S. PATENT DOCUMENTS

| | | | |
|---|---|---|---|
| 3,442,200 | 5/1969 | Babel | 221/150 HC |
| 4,308,444 | 12/1981 | Takagi et al. | 219/10.55 R |
| 4,323,773 | 4/1982 | Carpenter | 219/10.55 R |
| 4,398,651 | 8/1983 | Kumpfer | 221/150 HC |
| 4,592,485 | 6/1986 | Anderson et al. | 221/150 HC |
| 4,641,005 | 2/1987 | Seiferth | 219/10.55 F |
| 4,671,425 | 6/1987 | Knoll | 221/150 HC |
| 4,704,510 | 11/1987 | Matsui | 219/10.55 E |
| 4,851,631 | 7/1989 | Wendt | 219/10.55 E |

FOREIGN PATENT DOCUMENTS

| | | | |
|---|---|---|---|
| 2611465 | 9/1988 | France | 221/150 A |

*Primary Examiner*—H. Grant Skaggs
*Attorney, Agent, or Firm*—Burns, Doane, Swecker & Mathis

[57] ABSTRACT

A vending system for hot food comprises stacks of food-containing trays of a standard size, a microwave oven whose horizontal dimensions are similar to those of the trays and whose vertical dimension is preferably such as to produce a resonant cavity for the wavelength used, and means for feeding a selected one of the trays into the microwave oven on demand. The radiation is preferably introduced through a waveguide into the top of the tray. Each tray preferably carries heating instructions in machine readable code, e.g. as apertures on lateral extensions of a horizontal flange, and a reading head reads the instructions and adjusts the microwave oven accordingly. The stacks of trays may be held in a rotary magazine and selected by push-buttons.

64 Claims, 9 Drawing Sheets

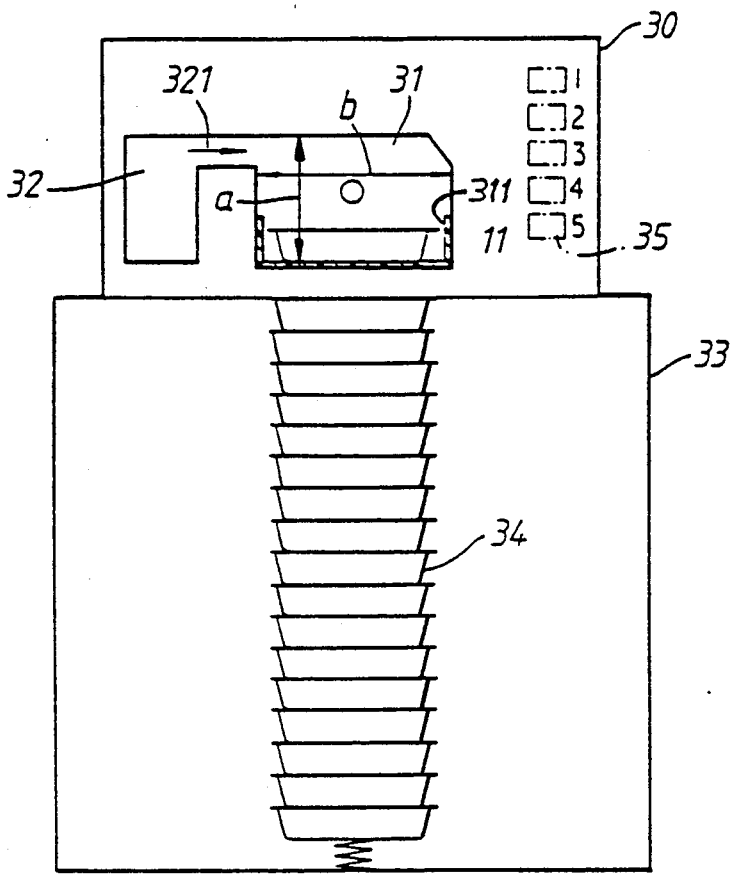
FIG. 6
FIG. 7
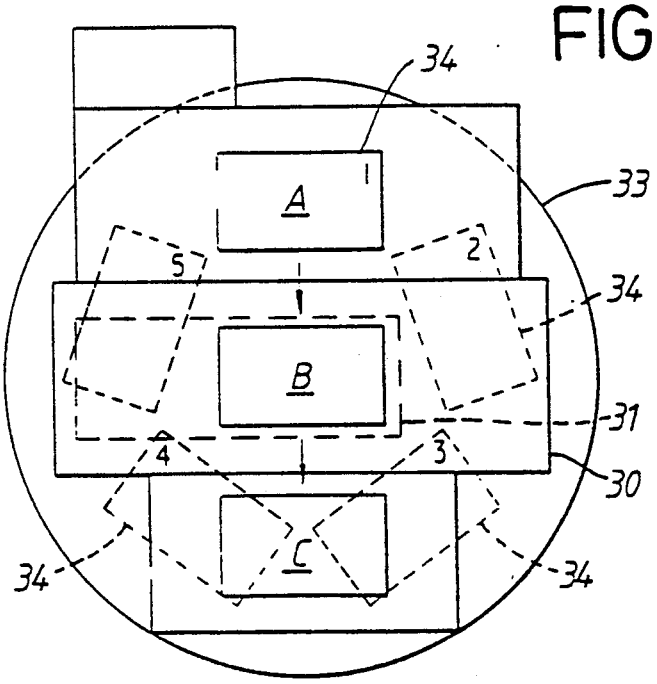

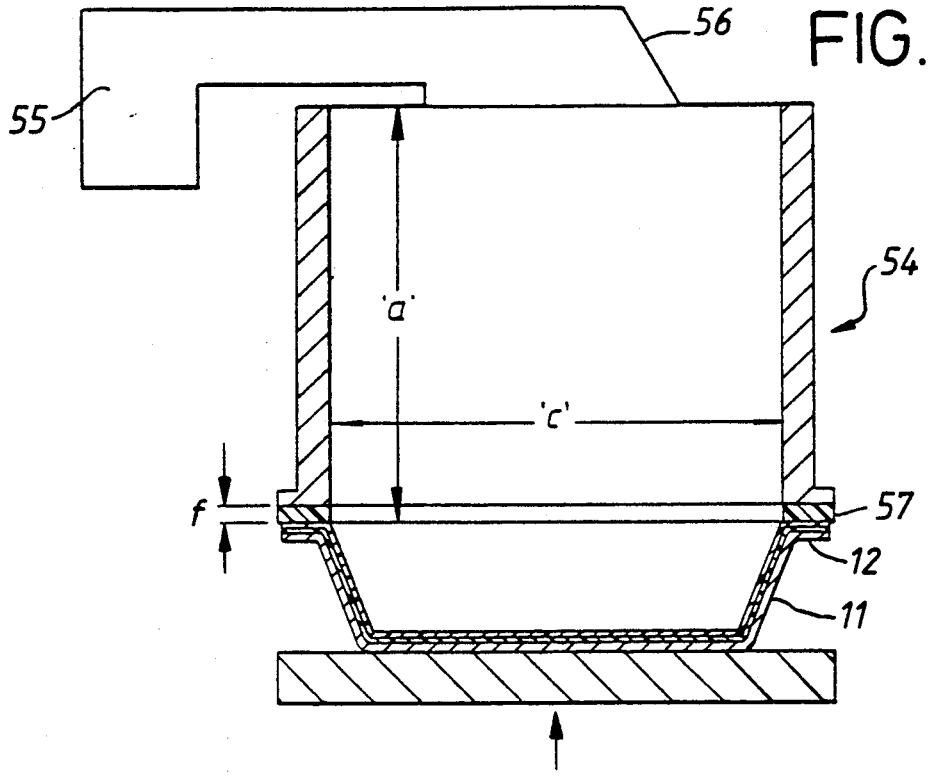
FIG. 9
FIG. 10
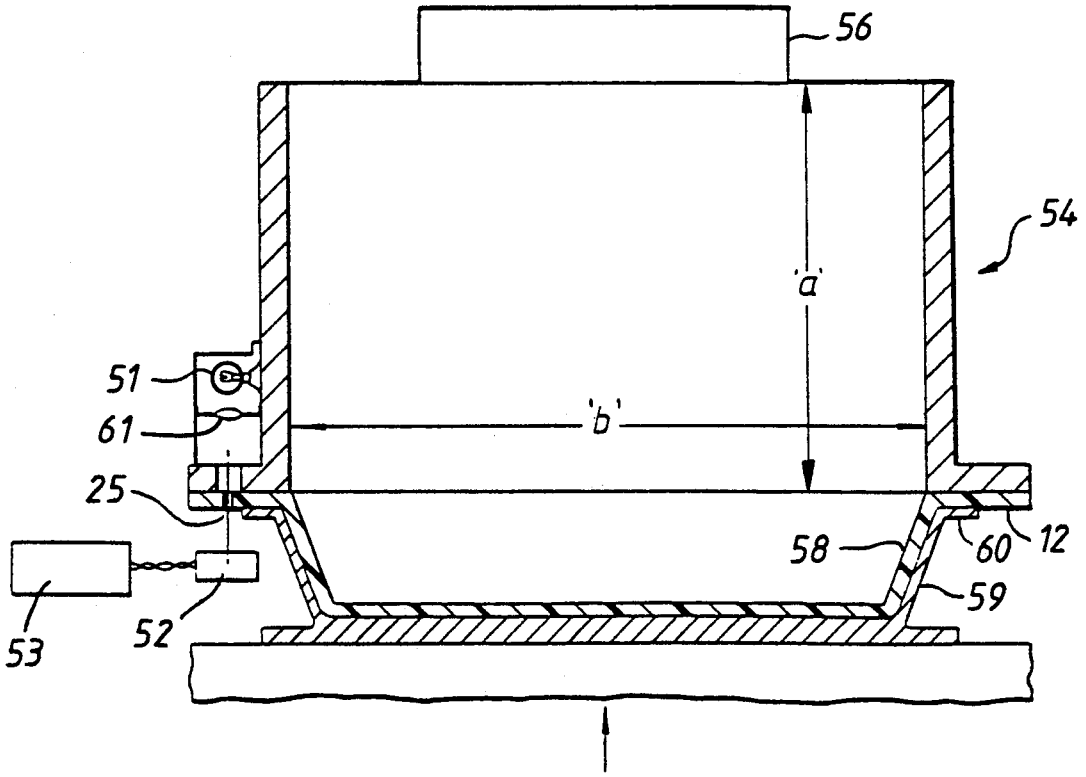

AVERAGE TEMPERATURE ATTAINED °C
90
80
70
60
50
73
72
71
70
2
2½
3
3½
4
4½
5
HEATING TIME (MINS)

90
80
70
60
50
AVERAGE TEMPERATURE ATTAINED °C
77
76
75
74
2
2½
3
3½
4
4½
5
HEATING TIME (MINS)

VENDING SYSTEMS FOR HOT FOODS

FIELD OF THE INVENTION

This invention relates to food vending systems incorporating microwave heating ovens for dispensing hot foods in containers.

BACKGROUND TO THE INVENTION

In such systems, it is essential to achieve rapid heating of the foods. It is also important that different varieties of food should be available and that each one should be heated

SUMMARY OF THE INVENTION

According to the present invention, a vending system for dispensing containers of hot food comprises a stack of food-containing trays of a standard size, a microwave oven whose horizontal dimensions are similar to those of the trays and exceed them only by an amount sufficient to prevent arcing, and means for feeding one of said trays into the microwave oven on demand.

Preferably the vertical dimension of the microwave oven is chosen to ensure that a resonant cavity is produced for microwave radiation of the wavelength used. The radiation is preferably introduced through a waveguide into the top of the tray in the oven. This dimensioning and arrangement of the microwave oven has been found to produce particularly efficient and rapid heating of the food. The introduction of radiation into the top of the tray is particularly important where trays of a metal/polymer laminate are employed.

The vending system preferably comprises a plurality of stacks of food-containing trays of standard size containing a corresponding number of different varieties of food, each tray carrying heating instructions in a machine readable code, means for feeding a tray from a selected stack into the oven, and a reading head adapted to read the heating instructions and to supply a corresponding control signal to the microwave oven. The heating instructions may be provided on lateral extensions of a horizontal flange extending outwardly from an upwardly extending wall of each tray. They may, for example, comprise apertures in the horizontal flange, for use with an optical reading head, or blind recesses or depressions in the flange, for use with an electromechanical reading head, or encodements in a strip of magnetic material (such as is used on bank cards) deposited on the horizontal flange, for use with an electronic reading head.

The vending system preferably further comprises a magazine for containing the plurality of stacks of trays, means for rotating the magazine to bring a selected stack of trays into position adjacent to an entry door of the oven, means for removing a lid from the uppermost tray of the selected stack, means for opening the entry door, means for introducing said uppermost tray into the oven through the entry door, means for closing the entry door and an exit door of the oven, and means for opening the exit door on completion of the heating of the food in the tray.

The trays are preferably formed of a laminate of a metal and a polymer, or of a laminate of different polymers chosen to provide the laminate with a high barrier to oxygen permeation.

Specific embodiments of the invention will now be described in more detail by way of example and with reference to the accompanying drawings in which:

BRIEF DESCRIPTION OF THE DRAWINGS

FIG. 6 is a diagrammatic elevation of a vending machine in accordance with the invention, FIG. 7 is a diagrammatic plan view of the machine of FIG. 6, FIG. 9 is a diagrammatic sectional view of an alternative form of microwave oven, with a tray made of a metal/polymer laminate, FIG. 10 is a diagrammatic sectional view of the oven of FIG. 9, taken at right angles to the view of FIG. 9, with a tray of an all-polymer laminate, and also showing one form of machine for reading heating instructions.

DETAILED DESCRIPTION OF THE PREFERRED EMBODIMENTS

Figure 1:
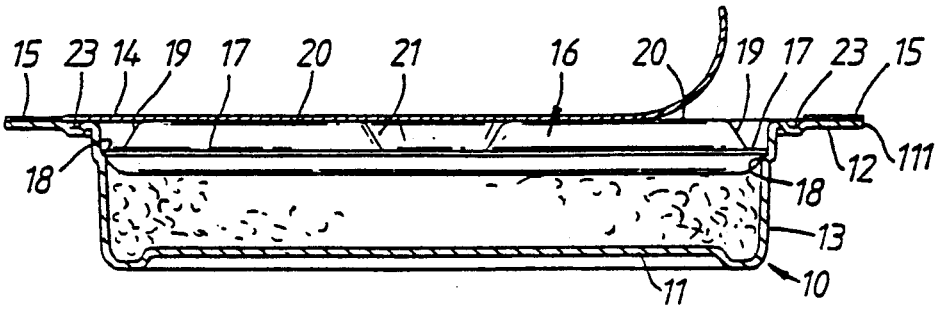
FIG. 1 is a vertical cross-section through a food container.
Figure 2:
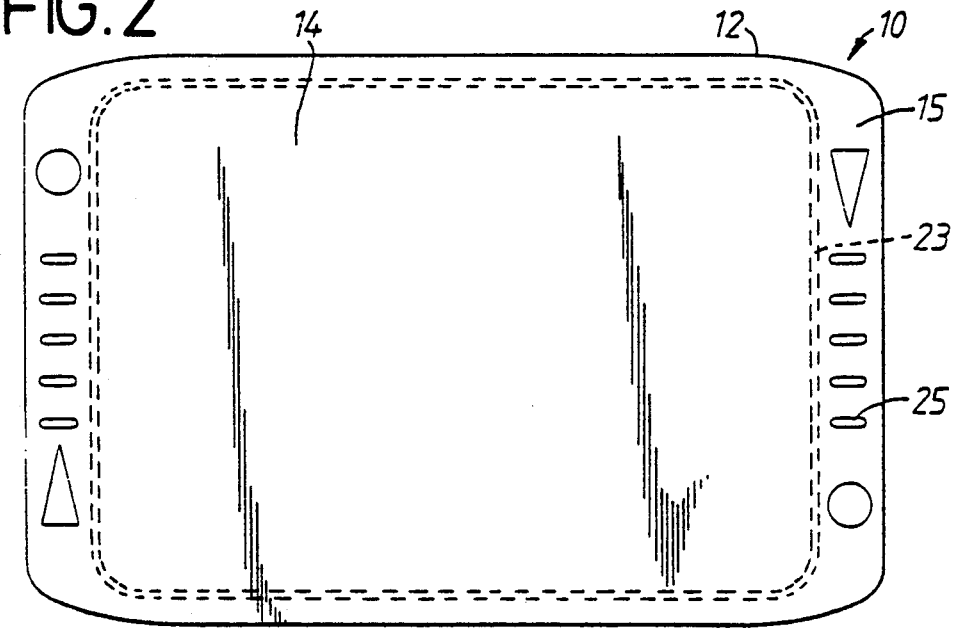
FIG. 2 is a plan view of the food container of FIG. 1, schematically showing one form of machine readable heating instructions.
Figure 3:
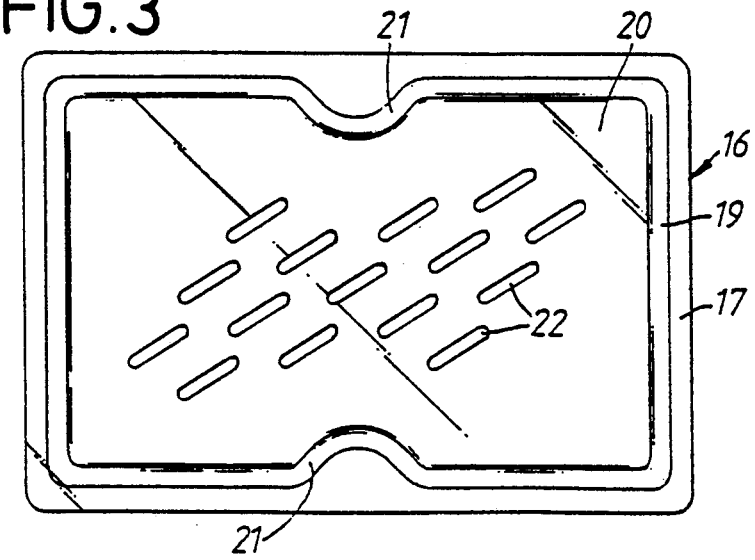
FIG. 3 is a plan view of the inner lid.
Figure 4:
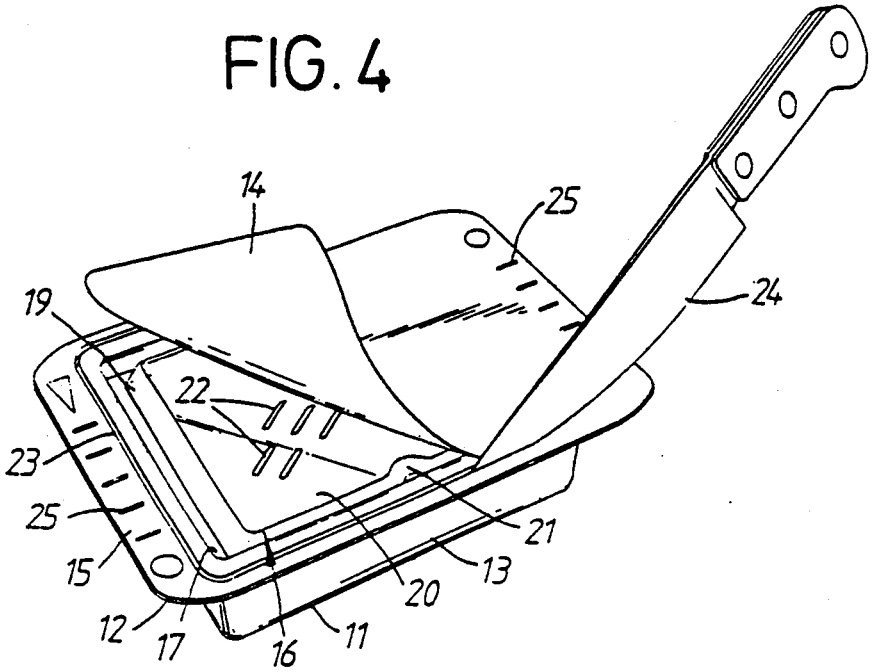
FIG. 4 is a perspective view from above of the container of FIGS. 1 and 2, showing removal of the outer lid.
Figure 5:
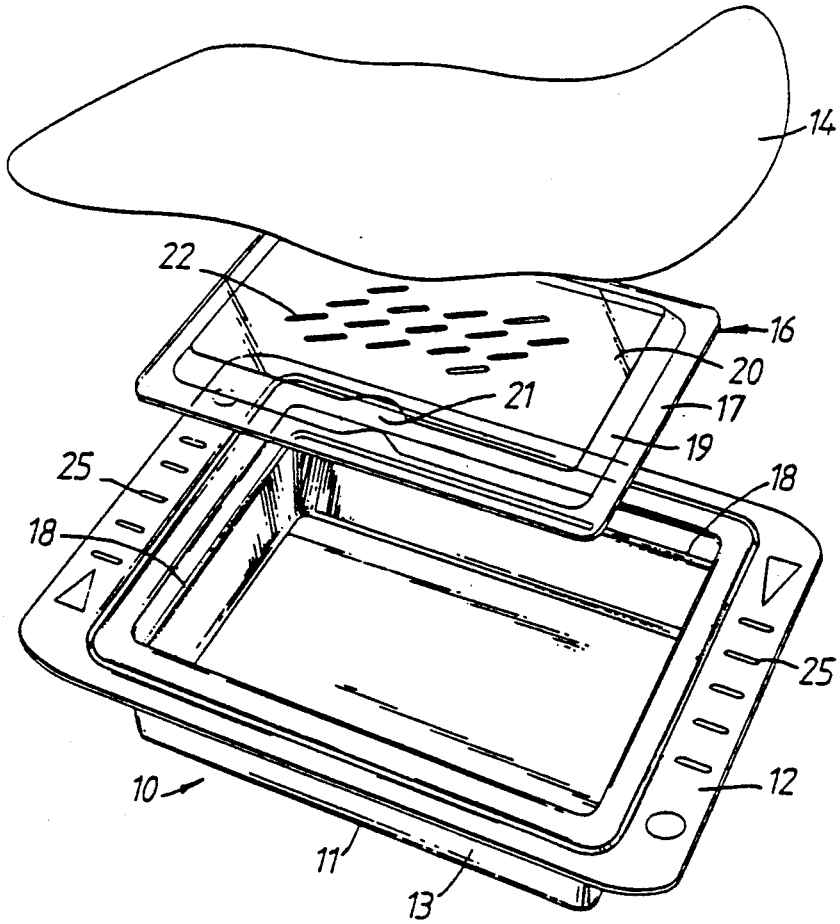
FIG. 5 is an exploded perspective view of the container.

As illustrated in FIGS. 1 to 5, a food container 10 intended for containing food which is to be heated or reheated in the container, in a vending machine incorporating a microwave oven, comprises a substantially rectangular tray 11 with a horizontal flange 12 extending outwardly from an upwardly extending wall 13 around its periphery and a flat outer lid 14 heat-sealed to the horizontal flange 12 in a marginal zone 15, all around the periphery of the flange. At the ends 111 of the rectangular tray 11, the flange 12 is extended so as to be wider than it is along the sides of the tray, in order to provide a convenient pair of handles for carrying the tray. The tray 11 is preferably made of a laminate of a metal and polymer, e.g. as described in our co-pending British Patent Application No. 8724237.

The container 10 further comprises an inner lid 16 (shown in plan view in FIG. 3) of substantially rigid material, e.g. of a transparent polymeric material. The inner lid 16 has a peripheral flange 17 which is seated on an inward step 18 in the wall 13 of the tray. The inner lid 16 also has an inclined portion 19 extending upwardly from the peripheral flange 17 and a flat top portion 20 which supports the outer lid 14 flush with the horizontal flange 12 of the tray. The inclined portion 19 is formed with indented formations 21 on opposite sides of the inner lid to form finger holds whereby the inner lid 16 may be grasped and removed after the outer lid 14 has been removed. The flat top portion 20 of the inner lid is formed with perforations 22 to allow escape of steam or expanding gases during heating of the contents of the container.

The horizontal flange 12 is formed with a groove 23 extending around its upper surface to form a guide for a knife (shown at 24 in FIG. 4) for removal of that portion of the outer lid 14 which lies inside the marginal zone 15 and the groove 23.

The food container 10 is intended for microwave heating or re-heating of its contents, in a vending machine according to the invention, incorporating a microwave oven. Heating instructions in a machine readable code are provided on the outer lid 14 or on the tray 11, located so that they can be read by a reading head such as that shown at 52 in FIG. 8, arranged to supply an appropriate control signal to the microwave oven. The heating instructions may, for example, comprise apertures in the flange 12, as indicated diagrammatically at 25, for use with an optical reading head comprising a light source and a sensor in the form of a plurality of photo cells arranged to receive light from the source through the apertures. In that case, the outer lid will be transparent or will be formed with apertures corresponding to those in the flange 12.

Figure 13:
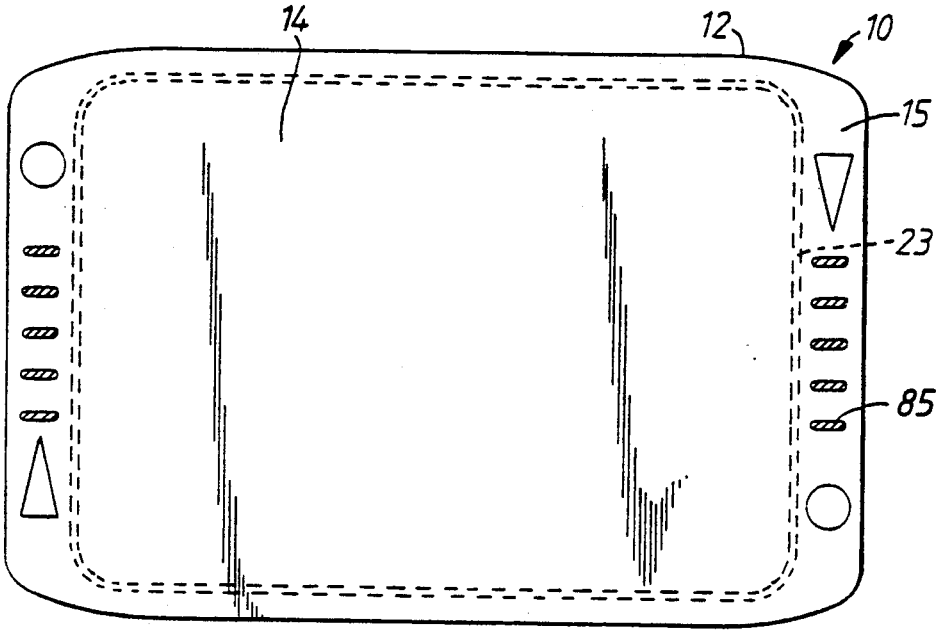
FIGS. 13 and 14 are plan views of food containers similar to FIG. 2, but schematically showing other forms of machine readable heating instructions
Figure 14:
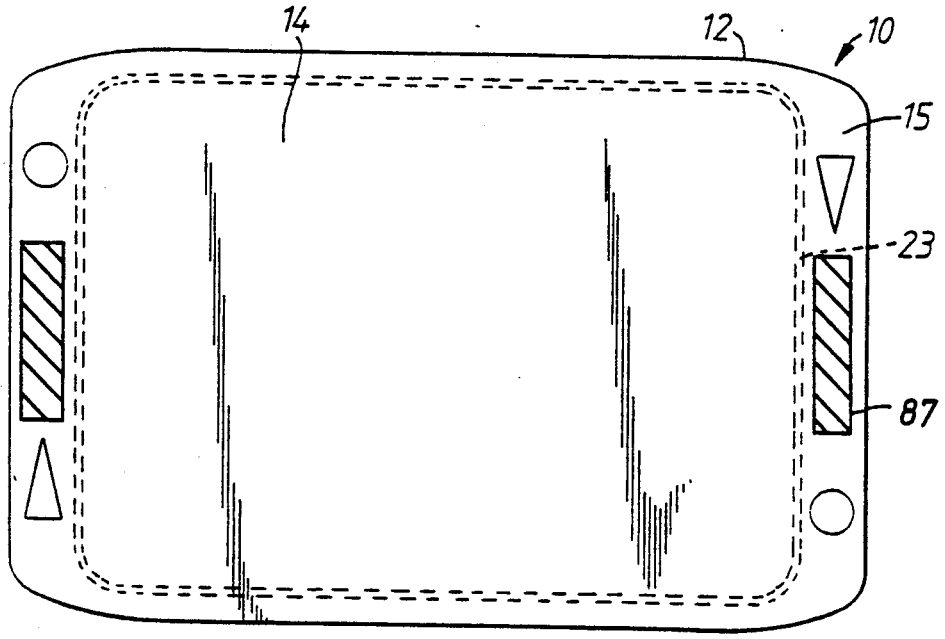
Figure 15:
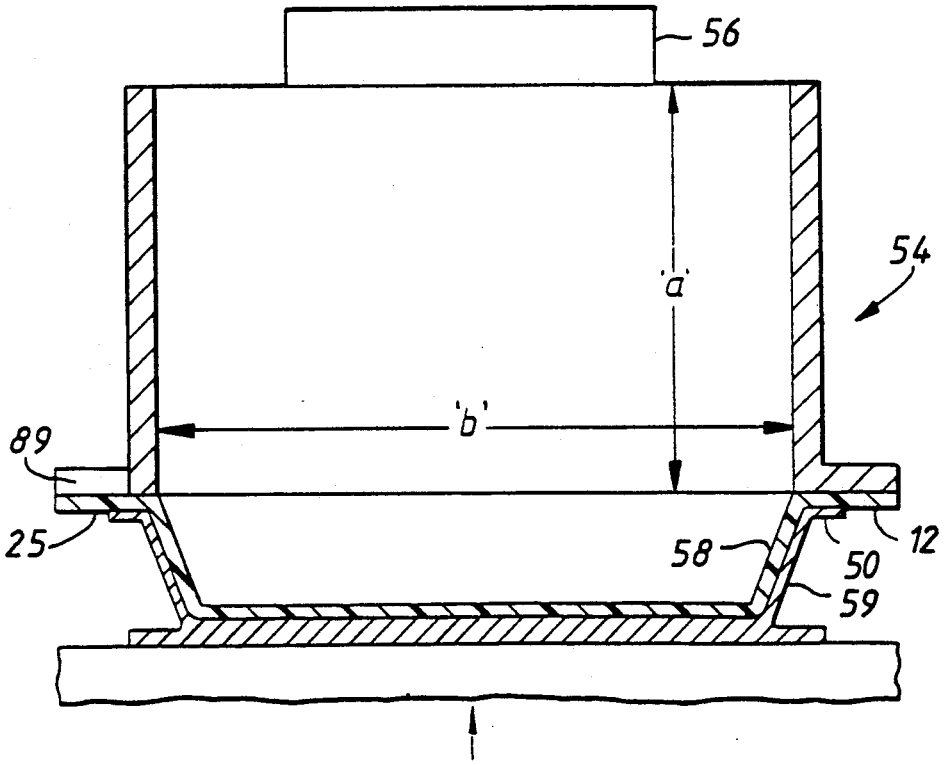
FIG. 15 is a diagrammatic sectional view similar to FIG. 10, but schematically showing the use of an electromechanical or electronic reading head.

Alternatively, the heating instructions may comprise blind recesses or depressions schematically indicated by the shaded areas 85 in the flange 12 of FIG. 13, for cooperating with an electromechanical reading head comprising an array of resiliently mounted pins coupled to micro-switches. FIG. 15 at 89 schematically shows a reading head which could take such a form. In a further alternative, a strip of magnetic material (such as is used on bank cards and as is schematically depicted at 87 in FIG. 14) may be deposited on the flange 12 and carry encoded heating instructions readable by an electronic reading head. The reading head schematically shown at 89 in FIG. 15 could take such a form.

A vending machine according to the invention suitable for using containers as described above is diagrammatically illustrated in FIGS. 6 to 8. It comprises an oven enclosure 30 enclosing a microwave oven 31 energised by a magnetron 32 and mounted on top of a magazine 33 containing a number of stacks 34 of containers 10 as described above, all being of a standard size and shape and having inner lids 16 and outer lids 14. As shown in FIG. 7, the magazine 33 may be in the form of a rotary carousel containing, for example, five stacks 34 of containers 10 containing five different varieties of food. Five selector buttons 35 are accordingly provided on the oven enclosure 30 and connected to a drive mechanism such that on pressing one of the buttons 35 the corresponding stack 34 is brought to a position for introducing the topmost tray into the oven 31 (position A as shown in FIG. 7).

As mentioned above, trays 11 of a metal/polymer laminate may be used, specifically a laminate comprising an outer layer of polyethylene terephthalate (PET), a middle layer of electrolytically chrome coated steel (ECCS) and an inner layer of polypropylene (PP). Such trays have many advantages, e.g. in the barrier which they provide against oxygen permeation into the food, but they are opaque to microwave radiation and hence result in slower food heating rates in a microwave oven of standard design, because the radiation can only enter the contents of the tray from above. The inventors have found, however, that food heating rates can be improved with such metal/polymer laminate trays by use of a microwave oven whose horizontal dimensions are similar to those of the trays and exceed them only by an amount necessary to prevent arcing, and which preferably has its vertical dimension chosen to ensure that a resonant cavity is produced for microwave radiation of the wavelength used. For this to be the case, the following equation must be satisfied:

$$\frac{1}{\lambda_0^2} = \left(\frac{1}{2a}\right)^2 + \left(\frac{m}{2b}\right)^2 + \left(\frac{n}{2c}\right)^2$$

where $\lambda_0$ is the wavelength (normally 122 mm), a, b and c are the internal dimensions of the oven in mm, and l, m and n are positive integers.

Figure 11:
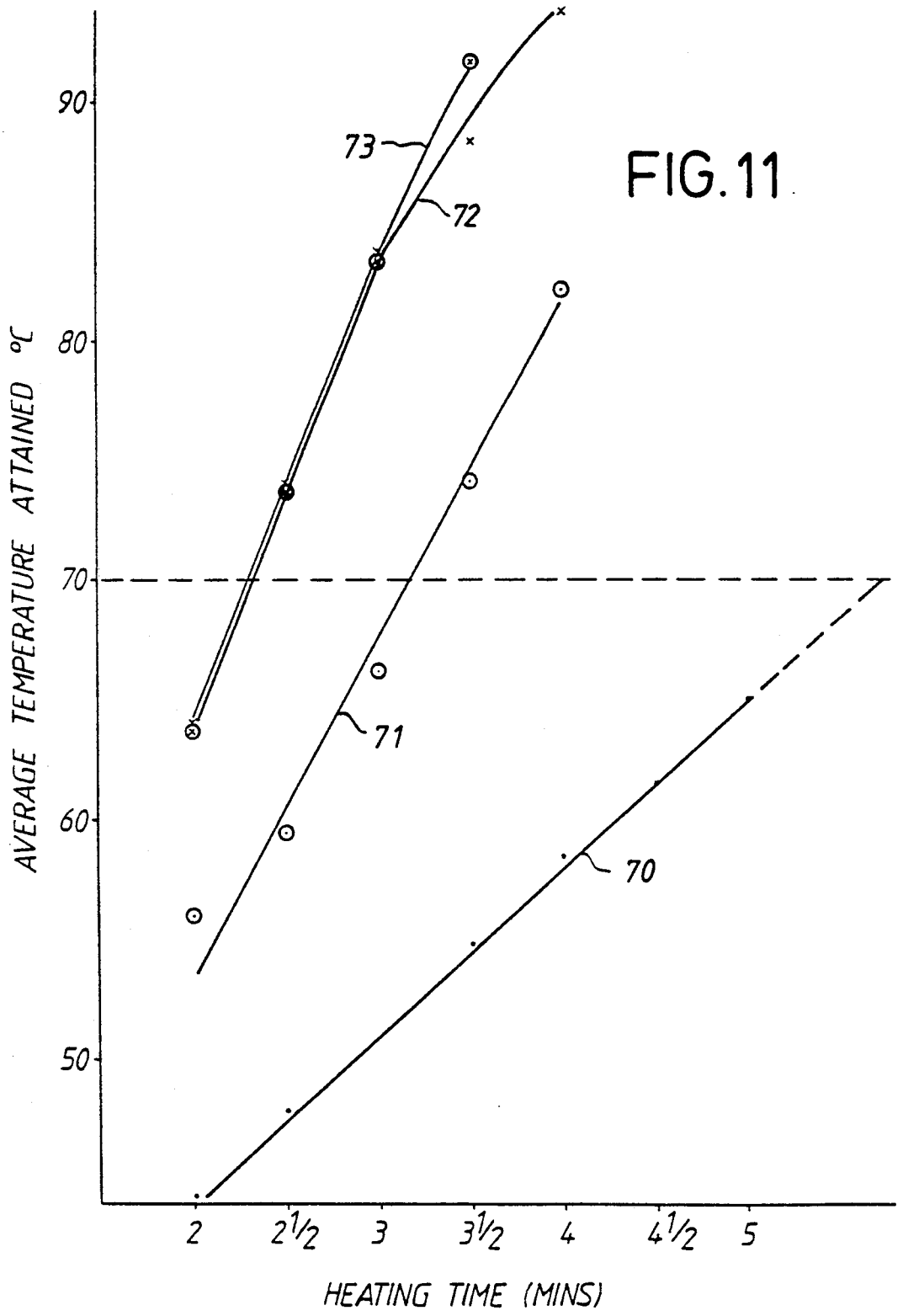
FIG. 11 is a graph showing the heating rates achieved with a standard microwave oven and an oven in accordance with the invention, for a liquid capable of convective movement.
Figure 12:
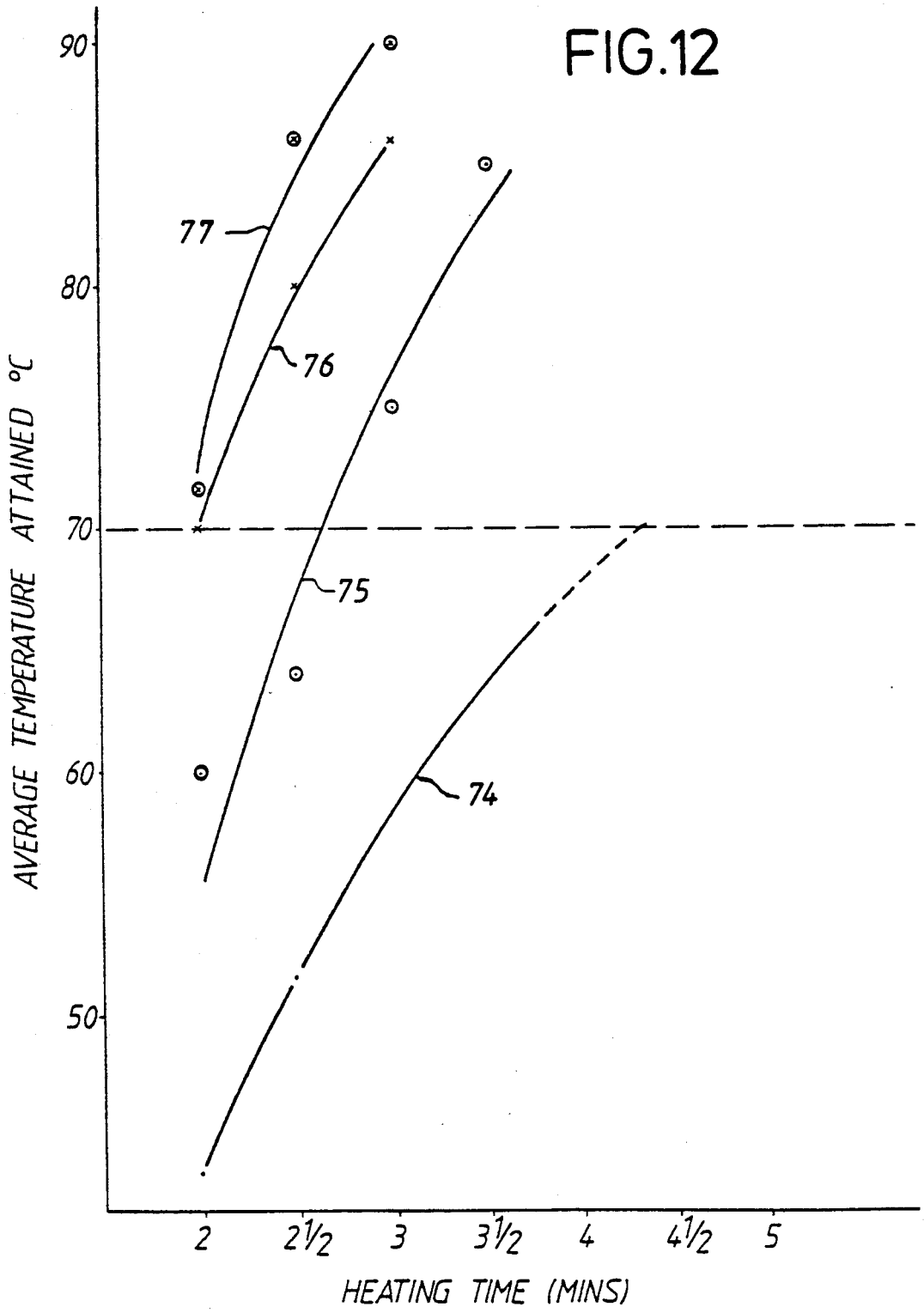
FIG. 12 is a similar graph for a substance simulating particulate food not capable of convective movement.

FIGS. 11 and 12 illustrate heating rates measured using, firstly, a standard microwave oven with dimensions substantially greater than those of the trays 11 and, secondly, a modification of the same oven in which a cavity with horizontal dimensions b, c, only 10 mm greater than those of the trays 11 and a height a to satisfy the equation set out above was constructed below the waveguide through which the microwave radiation entered the oven. Specifically, the standard oven had a height a of 24.5 cm, a width b of 33 cm and a depth c from front to back of 37 cm, while the cavity in the modified oven had dimensions a=15 cm, b=17.8 cm and c=12.8 cm, to accommodate trays of height 4.2 cm and horizontal dimension 16.8×11.8 cm. Curves 70,71 in FIG. 11 show the heating rates measured with water, simulating a liquid food capable of convective movement, in loosely covered trays 11 of a thin steel coated with an organic insulating lacquer. Curve 70 shows the slow heating rate achieved in the standard microwave oven and curve 71 shows the much higher rate achieved in the modified oven. For comparison, curves 72,73 show the heating rates achieved in trays of a laminated plastic material comprising polypropylene inner and outer layers with a middle layer of polyvinylidenechloride (PvdC), in the standard and modified oven respectively. No substantial difference is to be seen. The typical food serving temperature of 70° C. is reached in about 2.5 seconds in the laminated plastic tray, as against about 3.3 seconds in the coated metal tray in the modified oven and an extrapolated time of about 6 seconds for the coated metal tray in the standard oven.

FIG. 12 shows the results obtained with a starch solution, simulating the behaviour of a particulate food incapable of convective heat transfer movement. The curves 74,75 show respectively the slow heating achieved in the coated metal trays in the standard oven and the substantially faster heating achieved in these trays in the modified oven. Curves 76,77 show the results obtained with the laminated plastic trays in the standard and modified ovens, respectively, and indicate that the modified oven gave some improvement in heating rate at high temperatures.

In the light of the foregoing results, the microwave oven 31 of FIG. 6 may be so dimensioned that its internal horizontal dimensions exceed those of the tray 11 by substantially 10 mm, so as to allow a gap of 5 mm between the flange 12 and the oven walls to prevent arcing while the vertical dimension is chosen to ensure that a true resonant cavity is produced for microwave radiation of the wavelength used. The radiation is introduced through a waveguide 321 into the top of the tray 11 in the oven 31.

Whilst a gap of 5 mm between the flange 12 and the oven walls is sufficient to prevent arcing, the gap may be reduced to substantially zero, so that the trays 11 are a sliding fit in the oven, if the oven walls are provided with a cladding as shown at 311 of a material which is transparent to microwaves (i.e. is microwave passive) and has a dielectric strength higher than that of air. For example, a polypropylene film 1 mm thick may be applied to the walls of the oven at 311 up to a level above the tops of the trays 11, and may also cover the floor of the oven as shown. The use of a minimal gap makes it easier to ensure that the reading head lines up with the coded heating instructions on the flange 12.

Figure 8:
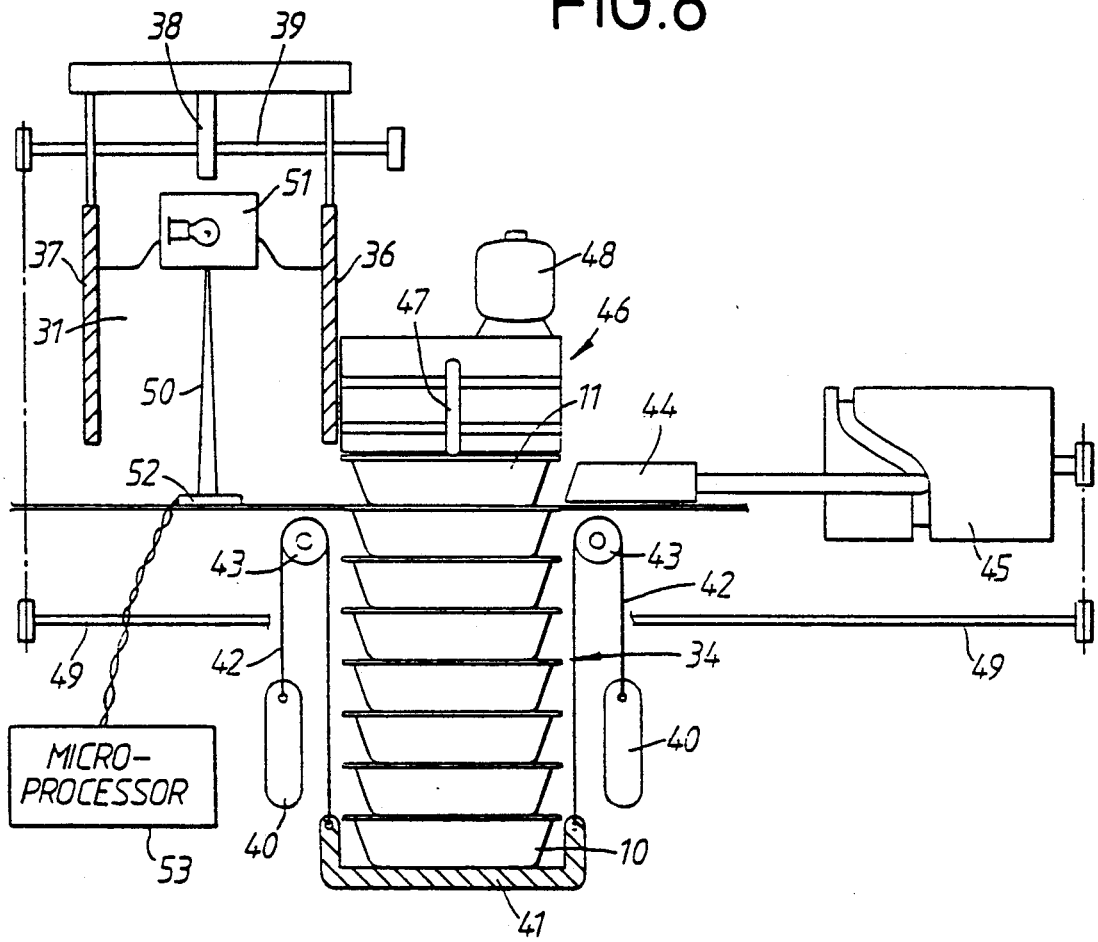
FIG. 8 is a diagrammatic sectional view of the loading station of the machine of FIGS. 6 and 7.

FIG. 8 illustrates diagrammatically an arrangement for introducing the tray 11 of the uppermost container 10 into the microwave oven 31 (position B in FIG. 7). In this arrangement, the microwave oven 31 has vertically movable entry and exit doors 36,37 whose movement is controlled by a lift cam 38 mounted on a rotary shaft 39. The stack 34 of containers 10 is constantly urged upwardly, e.g. by a pair of weights 40 attached to a cradle 41 by wires 42 passing over pulleys 43. A horizontally movable pusher element 44 normally lies over the top of the uppermost container 10, but when a button 35 has been pressed the pusher 44 is withdrawn by rotation of a desmodromic cam 45 to the position shown in FIG. 8 which allows the uppermost container 10 to rise into contact with a cutting mechanism 46 for removal of the outer lid 14. The cutting mechanism 46 may consist of, for example, a series of vertical knives 47 (only one of which is seen in FIG. 8) which are driven around a rectangular course by a motor 48 to sever the outer lid 14 on a line coinciding with the peripheral groove 23 in the flange 12. When the outer lid 14 has been severed, the pusher 44 is urged by the cam 45 to the left as seen in FIG. 8. At the same time, through a mechanical connection diagrammatically indicated as a shaft 49, the lift cam 38 lifts the entry and exit doors 36 and 37 so that the tray 11 can be pushed into the oven 31. As the tray 11 reaches the appropriate heating position in the oven 31, an optical reading head comes into operation as follows: A beam of light 50 from a lamp 51 impinges on the flange 12 and a sensor 52 picks up the heating instructions from the coded information 25 and passes them to a microprocessor 53 which then determines the appropriate supply of energy to the microwave oven 31, and closes the doors 36,37.

On completion of the appropriate degree of heating, as determined by the microprocessor 53, the entry and exit doors 36,37 are again raised. The customer can then reach into the oven and remove the container 10, or a separate removal mechanism may be provided.

FIGS. 9 and 10 illustrate an alternative form of microwave oven 54 with a magnetron 55 and a waveguide 56 leading the microwave radiation into the oven from the top. The bottom of the oven 54 is open and is situated over a stack of the trays 11, with means operable to press a selected tray up against the underside of the walls of the oven 54 on selection. The tray 11 of FIG. 9 is of a metal/polymer laminate as described above composed of PET/ECCS/PP. A ring 57 of polypropylene of thickness t is attached to the bottom of the oven walls to form a seal with the flange 12 of the tray 11. In view of the transparency to microwaves of the ring 57, a shield (not shown) must be provided outside it to contain the radiation. The thickness t of the ring 57 would normally be about 1 mm. If the inner layer of polypropylene on the tray 11 were thick enough to prevent arcing, the ring 57 could be dispensed with.

As shown in FIG. 10, trays 58 of laminated plastic material as described above may alternatively be used. In this case, the tray 58 is supported by a metal cup or dish 59 with an outturned peripheral flange 60, to contain the radiation and provide the necessary rigidity. FIG. 10 also shows how the lamp 51 and sensor 52 may be arranged at the side of the oven 54, with a lens 61 to direct the light from the lamp 51 through the apertures 25 in the flange 12 on the sensor 52.

What is claimed is:

1. A vending system for dispensing containers of hot food, comprising:

a plurality of stacks of food-containing trays containing a corresponding number of different varieties of food, each tray carrying machine readable heating instructions on a lateral extension of a horizontal flange extending outward from an upwardly extending wall of the tray;

a microwave oven whose horizontal dimensions are those of the trays and exceed them only by up to 10 mm, the vertical dimension of the microwave oven to ensure that a resonant cavity, bounded by one of the trays, is produced for microwave radiation of the wavelength used;

a reading head adapted to read the heating instructions and to supply a corresponding control signal to the microwave oven; and means for feeding one of said trays into the microwave oven on demand.

2. A vending system according to claim 1 wherein the heating instructions comprise apertures in the horizontal flange, for use with an optical reading head.

3. A vending system according to claim 2 wherein the lid is transparent.

4. A vending system according to claim 2 wherein the lid is formed with apertures corresponding to those in the flange.

5. A vending system according to claim 1 wherein the heating instructions comprise blind recesses or depressions in the flange, for use with an electromechanical reading head.

6. A vending system according to claim 1 wherein the heating instructions comprise encodements in a strip of magnetic material deposited on the horizontal flange, for use with an electronic reading head.

7. A vending system for dispensing containers of hot food, comprising:

a plurality of stacks of food-containing trays containing a corresponding number of different varieties of food, each tray carrying heating instructions;

a microwave oven whose horizontal dimensions are similar to those of the trays and exceed them only by up to substantially 10 mm, the vertical dimensions of the microwave oven being such as to ensure that a resonant cavity, bounded by one of the trays, is produced for microwave radiation of the wavelength used;

a magazine for containing the plurality of stacks of trays;

means for rotating the magazine to bring a selected stack of trays into position adjacent to an entry door of the oven;

means for cutting away a lid from the uppermost tray of the selected stack;

means for opening the entry door;

means for introducing said uppermost tray into the oven through the entry door;

means for closing the entry door and an exit door of the oven;

means for opening the exit door on completion of the heating of the food in the tray;

a reading head adapted to read the heating instructions and to supply a corresponding control signal to the microwave oven; and means for feeding one of said trays into the microwave oven on demand.

8. A vending system according to claim 7 further comprising means for removing the tray from the oven through the open exit door on completion of the heating.

9. A vending system for dispensing containers of hot food, comprising:

a plurality of stacks of food-containing trays containing a corresponding number of different varieties of food, each tray carrying machine readable heating instructions;

a microwave oven whose horizontal dimensions are similar to those of the trays and exceed them only by up to substantially 10 mm, the vertical dimensions of the microwave oven being such as to ensure that a resonant cavity, bounded by one of the trays, is produced for microwave radiation of the wavelength used;

a reading head adapted to read the heating instructions and to supply a corresponding control signal to the microwave oven; and means for feeding each tray vertically to contact the underside of the walls of the oven and to form the oven bottom during the heating of the food.

10. A vending system for dispensing containers of hot food, comprising:

a plurality of stacks of food-containing trays containing a corresponding number of different varieties of food, each tray carrying machine readable heating instructions on a lateral extension of a horizontal flange extending outwardly from an upwardly extending wall of the tray;

a microwave oven;

a reading head associated with the oven and adapted to read the heating instructions and to supply a corresponding control signal to the microwave oven; and means for feeding a tray from a selected stack to the microwave oven whereupon the heating instructions are presented to the reading head as the tray is fed to the microwave oven to control the microwave oven.

11. A vending system according to claim 10 wherein the heating instructions comprise apertures in the horizontal flange, for use with an optical reading head.

12. A vending system according to claim 11 wherein the lid is transparent.

13. A vending system according to claim 11 wherein the lid is formed with apertures corresponding to those in the flange.

14. A vending system according to claim 10 wherein the heating instructions comprise blind recesses or depressions in the flange, for use with an electromechanical reading head.

15. A vending system according to claim 10 wherein the heating instructions comprise encodements in a strip of magnetic material deposited on the horizontal flange, for use with an electronic reading head.

16. A vending system for dispensing containers of hot food, comprising:

a plurality of stacks of food-containing trays containing a corresponding number of different varieties of food, each tray carrying heating instructions;

a microwave oven;

a magazine for containing the plurality of stacks of trays;

means for rotating the magazine to bring a selected stack of trays into position adjacent to an entry door of the oven;

means for cutting away a lid from the uppermost tray of the selected stack;

means for opening the entry door;

means for introducing said uppermost tray into the oven through the entry door;

means for closing the entry door and an exit door of the oven;

means for opening the exit door on completion of the heating of the food in the tray;

a reading head associated with the oven and adapted to read the heating instructions and to supply a corresponding control signal to the microwave oven; and means for feeding a tray from a selected stack to the microwave oven whereupon the heating instructions are presented to the reading head as the tray is fed to the microwave oven to control the microwave oven.

17. A vending system according to claim 16 further comprising means for removing the tray from the oven through the open exit door on completion of the heating.

18. A vending system for dispensing containers of hot food, comprising:

a plurality of stacks of food-containing trays containing a corresponding number of different varieties of food, each tray carrying machine readable heating instructions;

a microwave oven;

a reading associated with the oven and adapted to read the heating instructions and to supply a corresponding control signal to the microwave oven; and means for feeding a tray from a selected stack to the microwave oven whereupon the heating instructions are presented to the reading head as the tray is fed to the microwave oven to control the microwave oven, wherein each tray is fed vertically to contact the underside of the walls of the oven and to form the oven bottom during the heating of the food.

19. A vending system for dispensing containers of hot food, comprising:

a plurality of food-containing trays containing a number of different varieties of food, each tray carrying heating instructions in a machine readable code on a lateral extension of a horizontal flange extending outwardly from an upwardly extending wall of the tray;

a microwave oven;

means for feeding a selected one of said trays to the microwave oven on demand, and a reading head adapted to read the heating instructions and to supply a corresponding control signal to the microwave oven.

20. A vending system according to claim 19 wherein the radiation is introduced through a waveguide into the top of the tray in the oven.

21. A vending system according to claim 19 wherein the plurality of food-containing trays are in a plurality of stacks and the means for feeding is operable to feed a tray from a selected stack into the oven whereupon the heating instructions are presented to the reading head as the tray is fed to the microwave oven to control the microwave oven.

22. A vending system according to claim 21 further comprising: a magazine for containing the plurality of stacks of trays, means for rotating the magazine to bring a selected stack of trays into position adjacent to an entry door of the oven, means for cutting away a lid from the uppermost tray of the selected stack, means for opening the entry door, means for introducing said uppermost tray into the oven through the entry door, means for closing the entry door and an exit door of the oven, and means for opening the exit door on completion of the heating of the food in the tray.

23. A vending system according to claim 22 further comprising means for removing the tray from the oven through the open exit door on completion of the heating.

24. A vending system according to claim 19 wherein the heating instructions comprise apertures in the horizontal flange, for use with an optical reading head.

25. A vending system according to claim 24 wherein the lid is transparent.

26. A vending system according to claim 24 wherein the lid is formed with apertures corresponding to those in the flange.

27. A vending system according to claim 19 wherein the heating instructions comprise blind recesses or depressions in the flange, for use with an electromechanical reading head.

28. A vending system according to claim 19 wherein the heating instructions comprise encodements in a strip of magnetic material deposited on the horizontal flange, for use with an electronic reading head.

29. A vending system according to claim 19 wherein each tray is fed vertically to contact the underside of the walls of the oven and to form the oven bottom during the heating of the food.

30. A vending system according to claim 19, wherein the trays are formed of a laminate of metal and a polymer.

31. A vending system according to claim 19, wherein the trays are formed of a laminate of different polymers chosen to provide the laminate with a high barrier to oxygen permeation.

32. A vending system according to claim 19 wherein the horizontal dimensions of the microwave oven are similar to those of the trays and exceed them only by up to substantially 10 mm.

33. A vending system for dispensing containers of hot food, comprising:

a plurality of stacks of food-containing trays containing a corresponding number of different varieties of food, each tray carrying heating instructions in a machine readable code;

a microwave oven;

a magazine for containing the plurality of stacks of trays;

means for rotating the magazine to bring a selected stack of trays into position adjacent to an entry door of the oven;

means for cutting away a lid from the uppermost tray of the selected stack;

means for opening the entry door;

means for introducing said uppermost tray into the oven through the entry door;

means for closing the entry door and an exit door of the oven;

means for opening the exit door on completion of the heating of the food in the tray; and a reading head adapted to read the heating instructions and to supply a corresponding control signal to the microwave oven.

34. A vending system according to claim 33 wherein the heating instructions are provided on lateral extensions of a horizontal flange extending outwardly from an upwardly extending wall of each tray.

35. A vending system according to claim 34 wherein the heating instructions comprise apertures in the horizontal flange, for use with an optical reading head.

36. A vending system according to claim 35 wherein the lid is transparent.

37. A vending system according to claim 35 wherein the lid is formed with apertures corresponding to those in the flange.

38. A vending system according to claim 34 wherein the heating instructions comprise blind recesses or depressions in the flange, for use with an electromechanical reading head.

39. A vending system according to claim 34 wherein the heating instructions comprise encodements in a strip of magnetic material deposited on the horizontal flange, for use with an electronic reading head.

40. A vending system according to claim 33 further comprising means for removing the tray from the oven through the open exit door on completion of the heating.

41. A vending system according to claim 33, wherein the trays are formed of a laminate of metal and a polymer.

42. A vending system according to claim 33, wherein the trays are formed of a laminate of different polymers chosen to provide the laminate with a high barrier to oxygen permeation.

43. A vending system according to claim 33 wherein the horizontal dimensions of the microwave oven are similar to those of the trays and exceed them only by up to substantially 10 mm.

44. A vending system according to claim 33 wherein the radiation is introduced through a waveguide into the top of the tray in the oven.

45. A vending system for dispensing containers of hot food, comprising:

a plurality of food-containing trays containing a number of different varieties of food, each tray carrying heating instructions in a machine readable code on a lateral extension of a horizontal flange extending outwardly from an upwardly extending wall of the tray;

a microwave oven whose horizontal dimensions are similar to those of the trays;

mans for vertically feeding a selected one of said trays on demand to contact the underside of the walls of the oven and to form the oven bottom during the heating of the food; and a reading head adapted to read the heating instructions and to supply a corresponding control signal to the microwave oven.

46. A vending system according to claim 45 wherein the radiation is introduced through a waveguide into the top of the tray in the oven.

47. A vending system according to claim 45 wherein the heating instructions comprise apertures in the horizontal flange, for use with an optical reading head.

48. A vending system according to claim 47 wherein the lid is transparent.

49. A vending system according to claim 47 wherein the lid is formed with apertures corresponding to those in the flange.

50. A vending system according to claim 45 wherein the heating instructions comprise blind recesses or depressions in the flange, for use with an electromechanical reading head.

51. A vending system according to claim 45 wherein the heating instructions comprise encodements in a strip of magnetic material deposited on the horizontal flange, for use with an electronic reading head.

52. A vending system according to claim 45, wherein the trays are formed of a laminate of metal and a polymer.

53. A vending system according to claim 45, wherein the trays are formed of a laminate of different polymers chosen to provide the laminate with a high barrier to oxygen permeation.

54. A vending system for dispensing containers of hot food, comprising:

a plurality of stacks of food-containing trays containing a corresponding number of different varieties of food, each tray carrying machine readable heating instructions on a lateral extension of a horizontal flange extending outwardly from an upwardly extending wall of the tray;

a microwave oven wherein the radiation is introduced through a waveguide into the top of the tray in the oven;

a reading head associated with the oven and adapted to read the heating instructions and to supply a corresponding control signal to the microwave oven; and means for feeding a tray from a selected stack to the microwave oven whereupon the heating instructions are presented to the reading head as the tray is fed to the microwave oven to control the microwave oven.

55. A vending system according to claim 54 wherein the horizontal dimensions of the microwave oven are similar to those of the trays and exceed them only by up to substantially 10 mm.

56. A vending system according to claim 54 wherein each tray is fed vertically to contact the underside of the walls of the oven and to form the oven bottom during the heating of the food, and wherein said trays are formed of a laminate of metal and a polymer.

57. A vending system according to claim 54 wherein the heating instructions comprise apertures in the horizontal flange, for use with an optical reading head.

58. A vending system according to claim 57 wherein the lid is transparent.

59. A vending system according to claim 57 wherein the lid is formed with apertures corresponding to those in the flange.

60. A vending system according to claim 54 wherein the heating instructions comprise blind recesses or depressions in the flange, for use with an electromechanical reading head.

61. A vending system according to claim 54 wherein the heating instructions comprise encodements in a strip of magnetic material deposited on the horizontal flange, for use with an electronic reading head.

62. A vending system according to claim 54 wherein the trays are formed of a laminate of different polymers chosen to provide the laminate with a high barrier to oxygen permeation.

63. A vending system according to claim 54 further comprising:

a magazine for containing the plurality of stacks of trays;

means for rotating the magazine to bring a selected stack of trays into position adjacent to an entry door of the oven;

means for cutting away a lid from the uppermost tray of the selected stack;

means for opening the entry door;

means for introducing said uppermost tray into the oven through the entry door;

means for closing the entry door and an exit door of the oven; and means for opening the exit door on completion of the heating of the food in the tray.

64. A vending system according to claim 54 further comprising means for removing the tray from the oven through the open exit door on completion of the heating.

* * * * *